US006569034B2

(12) United States Patent
Dewanjee et al.

(10) Patent No.: US 6,569,034 B2
(45) **Date of Patent: *May 27, 2003**

(54) GOLF BALL HAVING A POLYURETHANE COVER

(75) Inventors: Pijush K. Dewanjee, Carlsbad, CA (US); Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/063,801

(22) Filed: May 14, 2002

(65) Prior Publication Data

US 2003/0040379 A1 Feb. 27, 2003

Related U.S. Application Data

(60) Continuation of application No. 09/710,732, filed on Nov. 11, 2000, now Pat. No. 6,435,987, which is a division of application No. 09/361,912, filed on Jul. 27, 1999, now Pat. No. 6,190,268.

(51) Int. Cl.[7] ..... A63B 37/04; A63B 37/06; A63B 37/00

(52) U.S. Cl. ..... 473/371; 473/351

(58) Field of Search ..... 473/351–377

(56) References Cited

U.S. PATENT DOCUMENTS

| | | | | |
|---|---|---|---|---|
| 3,034,791 A | | 5/1962 | Gallagher | |
| 3,989,568 A | | 11/1976 | Isaac | |
| 4,123,061 A | | 10/1978 | Dusbiber | |
| 4,248,432 A | | 2/1981 | Hewitt et al. | |
| 4,349,657 A | | 9/1982 | Holloway | |
| 5,334,673 A | | 8/1994 | Wu | |
| 5,484,870 A | | 1/1996 | Wu | |
| 5,688,191 A | | 11/1997 | Cavallaro et al. | |
| 5,692,974 A | | 12/1997 | Wu et al. | |
| 5,803,831 A | | 9/1998 | Sullivan et al. | |
| 5,885,172 A | | 3/1999 | Herbert et al. | |
| 6,210,294 B1 | | 4/2001 | Wu | |
| 6,213,892 B1 | * | 4/2001 | Felker et al. | 473/370 |
| 6,422,954 B1 | * | 7/2002 | Dewanjee | 473/378 |
| 6,443,858 B2 | * | 9/2002 | Bartels et al. | 473/351 |
| 6,478,697 B2 | * | 11/2002 | Yagley et al. | 473/376 |
| 6,511,388 B1 | * | 1/2003 | Dewanjee | 473/377 |

* cited by examiner

*Primary Examiner*—Paul T. Sewell
*Assistant Examiner*—Alvin A. Hunter, Jr.
(74) *Attorney, Agent, or Firm*—Michael A. Catania

(57) ABSTRACT

A golf ball having a thermosetting polyurethane cover composed of a blend of polyurethane prepolymers is disclosed herein. The blend may be a dual blend with a TDI-based polyurethane prepolymer blended with a second diisocyanate polyurethane prepolymer, typically a PPDI-based polyurethane prepolymer. The blend may also be a tri-blend with a TDI-based polyurethane prepolymer blended with two other diisocyanate polyurethane prepolymers, typically two different PPDI-based polyurethane prepolymers. The golf ball has a durability of at least 3.5 on a shear test rating of the cover.

3 Claims, 2 Drawing Sheets

GOLF BALL HAVING A POLYURETHANE COVER

CROSS REFERENCES TO RELATED APPLICATIONS

This application is a continuation application of U.S. patent application Ser. No. 09/710,732, filed on Nov. 11, 2000, now U.S. Pat. No. 6,435,987, which is a divisional application of U.S. patent application Ser. No. 09/361,912, filed on Jul. 27, 1999, now U.S. Pat. No. 6,190,268.

FEDERAL RESEARCH STATEMENT

[Not Applicable]

BACKGROUND OF INVENTION

1. Field of the Invention

The present invention relates to a cover for a golf ball. More specifically, the present invention relates to a golf ball cover layer composed of a polyurethane formed from a blend of diisocyanate prepolymers.

2. Description of the Related Art

Conventionally golf balls are made by molding a cover around a core. The core may be wound or solid. A wound core typically comprises elastic thread wound about a solid or liquid center. Unlike wound cores, solid cores do not include a wound elastic thread layer. Solid cores typically may comprise a single solid piece center or a solid center covered by one or more mantle or boundary layers of material.

The cover may be injection molded, compression molded, or cast over the core. Injection molding typically requires a mold having at least one pair of mold cavities, e.g., a first mold cavity and a second mold cavity, which mate to form a spherical recess. In addition, a mold may include more than one mold cavity pair.

In one exemplary injection molding process each mold cavity may also include retractable positioning pins to hold the core in the spherical center of the mold cavity pair. Once the core is positioned in the first mold cavity, the respective second mold cavity is mated to the first to close the mold. A cover material is then injected into the closed mold. The positioning pins are retracted while the cover material is flowable to allow the material to fill in any holes caused by the pins. When the material is at least partially cured, the covered core is removed from the mold.

As with injection molding, compression molds typically include multiple pairs of mold cavities, each pair comprising first and second mold cavities that mate to form a spherical recess. In one exemplary compression molding process, a cover material is pre-formed into half-shells, which are placed into a respective pair of compression mold cavities. The core is placed between the cover material half-shells and the mold is closed. The core and cover combination is then exposed to heat and pressure, which cause the cover half-shells to combine and form a full cover.

As with the above-referenced processes, a casting process also utilizes pairs of mold cavities. In a casting process, a cover material is introduced into a first mold cavity of each pair. Then, a core is held in position (e.g. by an overhanging vacuum or suction apparatus) to contact the cover material in what will be the spherical center of the mold cavity pair. Once the cover material is at least partially cured (e.g., a point where the core will not substantially move), the core is released, the cover material is introduced into a second mold cavity of each pair, and the mold is closed. The closed mold is then subjected to heat and pressure to cure the cover material thereby forming a cover on the core. With injection molding, compression molding, and casting, the molding cavities typically include a negative dimple pattern to impart a dimple pattern on the cover during the molding process.

Materials previously used as golf ball covers include balata (natural or synthetic), gutta-percha, ionomeric resins (e.g., DuPont's SURLYN®), and polyurethanes. Balata is the benchmark cover material with respect to sound (i.e. the sound made when the ball is hit by a golf club) and feel (i.e. the sensation imparted to the golfer when hitting the ball). Natural balata is derived from the Bully Gum tree, while synthetic balata is derived from a petroleum compound. Balata is expensive compared to other cover materials, and golf balls covered with balata tend to have poor durability (i.e. poor cut and shear resistance). Gutta percha is derived from the Malaysian sapodilla tree. A golf ball covered with gutta percha is considered to have a harsh sound and feel as compared to balata covered golf balls.

Ionomeric resins, as compared to balata, are typically less expensive and tend to have good durability. However, golf balls having ionomeric resin covers typically have inferior sound and feel, especially as compared to balata covers.

A golf ball with a polyurethane cover generally has greater durability than a golf ball with a balata cover. The polyurethane covered golf ball generally has a better sound and feel than a golf ball with an ionomeric resin cover. Polyurethanes may be thermoset or thermoplastic. Polyurethanes are formed by reacting a prepolymer with a polyfunctional curing agent, such as a polyamine or a polyol. The polyurethane prepolymer is the reaction product of, for example, a diisocyanate and a polyol such as a polyether or a polyester. Several patents describe the use of polyurethanes in golf balls. However, golf balls with polyurethane covers usually do not have the distance of other golf balls such as those with covers composed of SURLYN® materials.

Gallagher, U.S. Pat. No. 3,034,791 discloses a polyurethane golf ball cover prepared from the reaction product of poly(tetramethylene ether) glycol and toluene-2,4-diisocyanates (TDI), either pure TDI or an isomeric mixture.

Isaac, U.S. Pat. No. 3,989,568 (the '568 patent) discloses a polyurethane golf ball cover prepared from prepolymers and curing agents that have different rates of reaction so a partial cure can be made. The '568 patent explains that the minimum number of reactants is three. Specifically, in '568 patent, two or more polyurethane prepolymers are reacted with at least one curing agent, or at least one polyurethane prepolymer is reacted with two or more curing agents as long as the curing agents have different rates of reaction. The examples in the '568 patent only disclose golf balls having covers that are about 0.025 inches thick.

Dusbiber, U.S. Pat. No. 4,123,061 (the '061 patent) discloses a polyurethane golf ball cover prepared from the reaction product of a polyether, a diisocyanate and a curing agent. The '061 patent discloses that the polyether may be polyalkylene ether glycol or polytetramethylene ether glycol. The '061 patent also discloses that the diisocyanate may be TDI, 4,4"-diphenylmethane diisocyanate (MDI), and 3,3"-dimethyl-4,4"-biphenylene diisocyanate (TODI). Additionally, the '061 patent discloses that the curing agent may be either a polyol (either tri- or tetra-functional and not di-functional) such as triisopropanol amine (TIPA) or trimethoylol propane (TMP), or an amine-type having at least two reactive amine groups such as: 3,3" dichlorobenzidene;

3,3" dichloro 4,4" diamino diphenyl methane (MOCA); N,N,N",N" tetrakis (2-hydroxy propyl) ethylene diamine; or Uniroyal's Curalon L which is an aromatic diamine mixture.

Hewitt, et al., U.S. Pat. No. 4,248,432 (the '432 patent) discloses a thermoplastic polyesterurethane golf ball cover formed from a reaction product of a polyester glycol (molecular weight of 800–1500) (aliphatic diol and an aliphatic dicarboxylic acid) with a para-phenylene diisocyanate (PPDI) or cyclohexane diisocyanate in the substantial absence of curing or crosslinking agents. The '432 patent teaches against the use of chain extenders in making polyurethanes. The '432 patent states, when small amounts of butanediol-1,4 are mixed with a polyester . . . the addition results in polyurethanes that do not have the desired balance of properties to provide good golf ball covers. Similarly, the use of curing or crosslinking agents is not desired . . . .

Holloway, U.S. Pat. No. 4,349,657 (the '657 patent) discloses a method for preparing polyester urethanes with PPDI by reacting a polyester (e.g. prepared from aliphatic glycols having 2–8 carbons reacted with aliphatic dicarboxylic acids having 4–10 carbons) with a molar excess of PPDI to obtain an isocyanate-terminated polyester urethane (in liquid form and stable at reaction temperatures), and then reacting the polyester urethane with additional polyester. The '657 patent claims that the benefit of this new process is the fact that a continuous commercial process is possible without stability problems. The '657 patent further describes a suitable use for the resultant material to be golf ball covers.

Wu, U.S. Pat. No. 5,334,673 (the '673 patent) discloses a polyurethane prepolymer cured with a slow-reacting curing agent selected from slow-reacting polyamine curing agents and difunctional glycols (i.e., 3,5-dimethylthio-2,4-toluenediamine, 3,5-dimethylthio-2,6-toluenediamine, N,N"-dialkyldiamino diphenyl methane, trimethyleneglycol-di-p-aminobenzoate, polytetramethyleneoxide-di-p-aminobenzoate, 1,4-butanediol, 2,3-butanediol, 2,3-dimethyl-2,3-butanediol, ethylene glycol, and mixtures of the same). The polyurethane prepolymer in the '673 patent is disclosed as made from a polyol (e.g., polyether, polyester, or polylactone) and a diisocyanate such as MDI or TODI. The polyether polyols disclosed in the '673 patent are polytetramethylene ether glycol, poly(oxypropylene) glycol, and polybutadiene glycol. The polyester polyols disclosed in the '673 patent are polyethylene adipate glycol, polyethylene propylene adipate glycol, and polybutylene adipate glycol. The polylactone polyols disclosed in the '673 patent are diethylene glycol initiated caprolactone, 1,4-butanediol initiated caprolactone, trimethylol propane initiated caprolactone, and neopentyl glycol initiated caprolactone.

Cavallaro, et al., U.S. Pat. No. 5,688,191 discloses a golf ball having core, mantle layer and cover, wherein the mantle layer is either a vulcanized thermoplastic elastomer, functionalized styrene-butadiene elastomer, thermoplastic polyurethane, metallocene polymer or blends of the same and thermoset materials.

Wu, et al., U.S. Pat. No. 5,692,974 discloses golf balls having covers and cores that incorporate urethane ionomers (i.e. using an alkylating agent to introduce ionic interactions in the polyurethane and thereby produce cationic type ionomers).

Sullivan, et al., U.S. Pat. No. 5,803,831 (the '831 patent) discloses a golf ball having a multi-layer cover wherein the inner cover layer has a hardness of at least 65 Shore D and the outer cover layer has a hardness of 55 Shore D or less, and more preferably 48 Shore D or less. The '831 patent explains that this dual layer construction provides a golf ball having soft feel and high spin on short shots, and good distance and average spin on long shots. The '831 patent provides that the inner cover layer can be made from high or low acid ionomers such as SURLYN®, ESCOR® or IOTEK®, or blends of the same, nonionomeric thermoplastic material such as metallocene catalyzed polyolefins or polyamides, polyamide/ionomer blends, polyphenylene ether/ionomer blends, etc., (having a Shore D hardness of at least 60 and a flex modulus of more than 30000 psi), thermoplastic or thermosetting polyurethanes, polyester elastomers (e.g. HYTREL®), or polyether block amides (e.g. PEBAX®), or blends of these materials. The '831 patent also provides that the outer cover layer can be made from soft low modulus (i.e. 1000–10000 psi) material such as low-acid ionomers, ionomeric blends, non-ionomeric thermoplastic or thermosetting materials such as polyolefins, polyurethane (e.g. thermoplastic polyurethanes like TEXIN®, PELETHANE®, and thermoset polyurethanes like those disclosed in Wu, U.S. Pat. No. 5,334,673), polyester elastomer (e.g. HYTREL®), or polyether block amide (e.g. PEBAX®), or a blend of these materials.

Hebert, et al., U.S. Pat. No. 5,885,172 (the '172 patent) discloses a multilayer golf ball giving a progressive performance (i.e. different performance characteristics when struck with different clubs at different head speeds and loft angles) and having an outer cover layer formed of a thermoset material with a thickness of less than 0.05 inches and an inner cover layer formed of a high flexural modulus material. The '172 patent provides that the outer cover is made from polyurethane ionomers as described in Wu, et al., U.S. Pat. No. 5,692,974, or thermoset polyurethanes such as TDI or methylenebis-(4-cyclohexyl isocyanate) (HMDI), or a polyol cured with a polyamine (e.g. methylenedianiline (MDA)), or with a trifunctional glycol (e.g., N,N,N",N"-tetrakis(2-hydroxpropyl)ethylenediamine). The '172 also provides that the inner cover has a Shore D hardness of 65–80, a flexural modulus of at least about 65,000 psi, and a thickness of about 0.020–0.045 inches. Exemplary materials for the inner cover are ionomers, polyurethanes, polyetheresters (e.g. HYTREL®), polyetheramides (e.g., PEBAX®), polyesters, dynamically vulcanized elastomers, functionalized styrene-butadiene elastomer, metallocene polymer, blends of these materials, nylon or acrylonitrile-butadiene-styrene copolymer.

Wu, U.S. Pat. No. 5,484,870 (the '870 patent) discloses golf balls having covers composed of a polyurea composition. The polyurea composition disclosed in the '870 patent is a reaction product of an organic isocyanate having at least two functional groups and an organic amine having at least two functional groups. One of the organic isocyanates disclosed by the '870 patent is PPDI.

Although the prior art has disclosed golf ball covers composed of many different materials, none of these golf balls have proven completely satisfactory. Dissatisfaction, for example, remains with processing and manufacturing the balls, and with the balls' durability and performance.

Specifically, with respect to processing, prior materials are not user friendly because certain starting materials may be unhealthful, such as diamines and isocyanides. In addition, prior balls using such materials are generally wound balls. Wound balls have tolerances that are more difficult to control due to core sizes and/or windings sizes, and therefore, require thicker cover layers to account for the manufacturing tolerances. With respect to durability problems, prior polyurethane covered balls, because they are wound balls, tend to lose compression and initial velocity due to the windings relaxing over time and use. With respect to performance problems, prior balls, as a general rule, tend to have smaller cores that result in shorter flight distances. Although many golf balls having a polyurethane cover have been provided by the prior art, these golf balls have failed to capture the sound and feel of balata while providing a golf ball with the durability of an ionomer.

SUMMARY OF INVENTION

One aspect of the present invention is a golf ball having a solid core, an intermediate layer and a cover. The core has a diameter of 1.35 inches to 1.64 inches. The core is composed of a polybutadiene material, zinc oxide, zinc stearate, zinc diacryalate, a peroxide, and tungsten in an amount of 2 to 10 parts per hundred parts of polybutadiene. The core has a PGA compression of 55 to 80 points.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
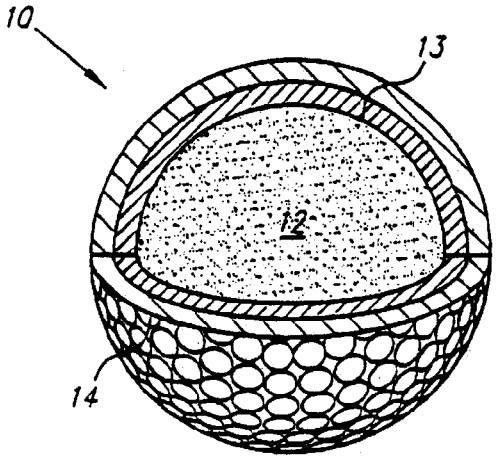
FIG. 1 illustrates a perspective view of a golf ball of the present invention including a cut-away portion showing a core, a boundary layer, and a cover.

As illustrated in FIG. 1, the golf ball of the present invention is generally indicated as 10. The golf ball 10 includes a core 12, a boundary layer 14 and a cover 16. Alternatively, as shown in FIG. 2, the golf ball 10 may only include a core 12 and a cover 16.

The cover 16 is a polyurethane cover having a predetermined hardness and a predetermined durability as measured on a cover strike plate drop test as further described below. The polyurethane cover 16 is composed of a polyurethane material formed from a blend of diisocyanate prepolymers. The blend of diisocyanate prepolymers includes at least one TDI-based polyurethane prepolymer and at least one other diisocyanate-based polyurethane prepolymer. In a preferred embodiment, the blend of diisocyanate prepolymers includes at least one PPDI-based polyurethane prepolymer and at least one TDI-based polyurethane prepolymer. Alternative embodiments have a blend which includes at least two different PPDI-based polyurethane prepolymer and at least one TDI-based polyurethane prepolymer. Yet further embodiments may include at least one TDI-based polyurethane prepolymer and at least one MDI-based polyurethane prepolymer. Those skilled in the pertinent art will recognize that multiple variations of diisocyanate prepolymers may be utilized without departing from the scope and spirit of the present invention.

Figure 2:
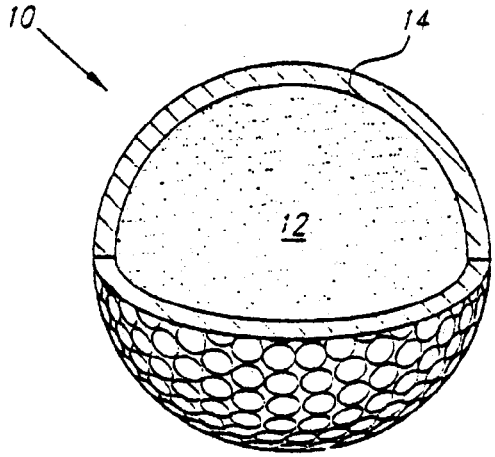
FIG. 2 illustrates a perspective view of a golf ball of the present invention including a cut-away portion core and a cover.

The polyurethane cover 16 encompasses a boundary layer 14, as shown in FIG. 1, or alternatively the cover 16 may encompass the core 12 as shown in FIG. 2. The boundary layer 14 is composed of a thermoplastic material that has a predetermined hardness. The boundary layer 14 will encompass the core 12. Each component of the golf ball 10 of the present invention will be described below in greater detail.

Figure 3:
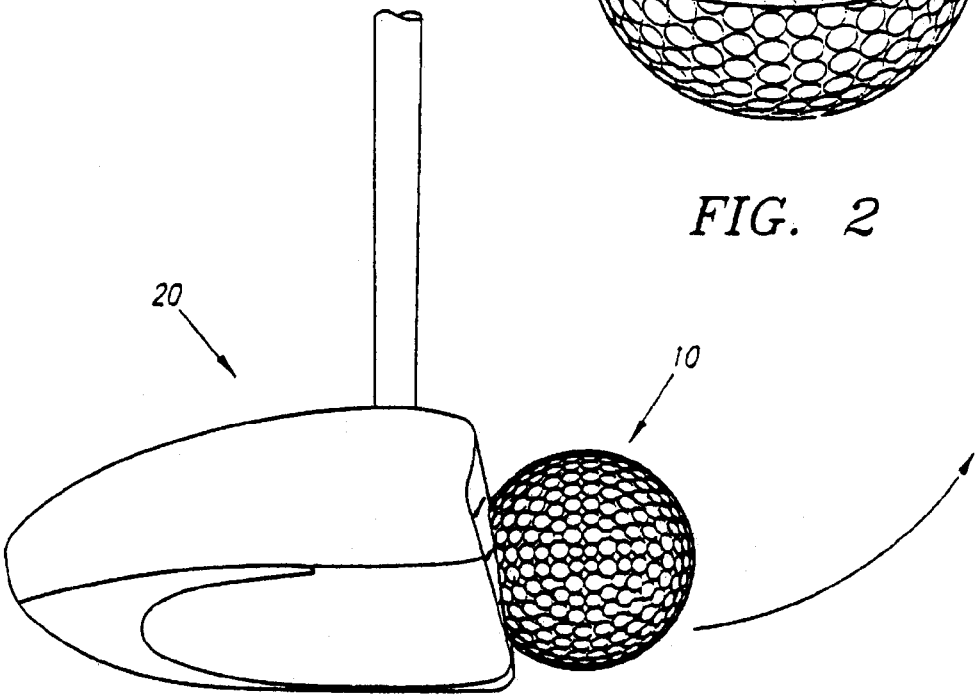
FIG. 3 illustrates a golf club hitting a golf ball.

The most important feature of the present invention is the durability of the cover. As shown in FIG. 3, the golf ball 10 is subjected to tremendous forces when impacted with a golf club 20 during a golf shot. The golf ball 10 of the present is capable of enduring, more than polyurethane covered golf balls of the prior art, slices or other incorrect hits by golfers. The unique polyurethane formulation for the cover 16 of the present invention provides this enhanced durability. Durability as defined herein is objectively measured through comparative testing of available golf balls versus the golf ball 10 of the present invention. The testing methods and results will be described below.

The polyurethane utilized in the present invention is composed of blend of a TDI-based prepolymer, a second diisocyanate-based polyurethane prepolymer and a curing agent. The TDI-based prepolymer is preferably formed from TDI and a polyether polyol. The second diisocyanate-based polyurethane prepolymer is preferably a PPDI-based prepolymer formed from PPDI and a polyester polyol, preferably a polycaprolactone. The prepolymer blend is cured with a curing agent. The curing agent, or curative, may be a diol (e.g., 1,4 butane diol, trimethylpropanol), a mixture of diols (e.g., 1,4 butane diol and ethylene glycol, or other suitable glycols), a hydroquinone, a mixture of hydroquinones, a triol, a mixture of triols, a diamine, a mixture of diamines, an oligomeric diamine, a triamine, or a blend of some or all of these materials. Preferably, the curing agent is a blend of a diamine and a mixture of diols.

In an alternative embodiment, the blend of prepolymers includes three diisocyanate-based polyurethane prepolymers. In this embodiment, the TDI-based prepolymer is preferably formed from TDI and a polyether polyol. The second diisocyanate-based polyurethane prepolymer is preferably a PPDI-based prepolymer formed from PPDI and a polyester polyol, preferably a polycaprolactone. The third diisocyanate-based polyurethane prepolymer is a PPDI-based prepolymer formed from PPDI and a polyether polyol. Preferably, the curing agent is a blend of a diamine and a mixture of diols. As mentioned above, alternative embodiments may have variations of the dual blend or the tri-blend, and may use a TDI-based polyurethane prepolymer with other non-PPDI-based polyurethane prepolymers.

As previously set forth in this Assignee's U.S. Pat. No. 6,117,024, entitled Golf Ball With Polyurethane Cover, filed on Apr. 20, 1999, which is hereby incorporated by reference in its entirety, a PPDI-based polyurethane prepolymer provides a polyurethane with a higher rebound at a lower hardness, greater durability and improved sound and feel. However, although the use of only a PPDI-based polyurethane prepolymer provides greater durability for a polyurethane cover, the polyurethane cover 16 of the present invention formed from a blend of prepolymers provides even greater durability.

The blending of a TDI-based prepolymer with other diisocyanate-based polyurethane prepolymers lowers the viscosity of the mixture, lowers the temperature of the exothermic reaction that occurs when the prepolymers are reacted with the curing agent, and increases the durability. The TDI-based prepolymer may range from 10 to 40 percent of the polyurethane prepolymer blend. Preferably, the TDI-based prepolymer is 30 percent of the polyurethane prepolymer blend. A preferred TDI based prepolymer is a TDI terminated polyether prepolymer available from Uniroyal Chemical Company of Middlebury, Conn., under the tradename ADIPRENE®® LF950.

The dual blend and tri-blend formulations will preferably contain a PPDI terminated polyester prepolymer and/or a PPDI terminated polyether prepolymer. A preferred PPDI terminated polyester prepolymer is available from Uniroyal Chemical under the tradename ADIPRENE®® LFPX 2950. A preferred PPDI terminated polyether prepolymer is available from Uniroyal Chemical under the tradename ADIPRENE® LFPX 950.

The polyurethane prepolymer blend may have 10 to 40 parts of a TDI terminated polyether prepolymer blended with 60 to 90 parts of a PPDI terminated polyether prepolymer. Alternatively, the polyurethane prepolymer blend may have 10 to 40 parts of a TDI terminated polyether prepolymer blended with 60 to 90 parts of a PPDI terminated polyester prepolymer. Further, the polyurethane prepolymer blend may have 10 to 40 parts of a TDI terminated polyether prepolymer blended with 5 to 90 parts of a PPDI terminated polyether prepolymer and 5 to 90 parts of a PPDI terminated polyester prepolymer. More specific blend formulations are set forth in the Examples below.

The cover 16 of the golf ball 10 of the present invention is most preferably composed of a polyurethane formed from a polyurethane prepolymer blend composed of a TDI-based polyurethane prepolymer and a PPDI-based polyurethane prepolymer, and cured with a mixture of curing agents such as a diamine and a blend of 1,4 butane diol and glycols. A suitable blend of diol and glycols is available from Uniroyal Chemical under the tradename VIBRACURE® A250. A suitable diamine is toluene ethylene diamine available from Albemarle Corporation of Baton Rouge, La. under the tradename ETHACURE® 100. Other agents which may be utilized during the curing process include dimethylthio-2,4-toluenediamine (such as EHTACURE® 300 available from Albemarle Corporation); trimethyl glycol di-p-aminobenzoate (such as VERSALINK® 740M available from Air Products and Chemicals, Inc., Allentown, Pa.); cyclohexane dimethanol; hydroquinone-bis-hydroxyethyl ether; phenyldiethanol amine mixture (such as VIBRACURE® A931 available from Uniroyal Chemical); methylene dianiline sodium chloride complex (such as CAYTOR® 31 available from Uniroyal Chemical); and/or prionene amine. This list of preferred agents (including chain extenders, cross-linkers and curing agents) is not meant to be exhaustive, as any suitable (preferably polyfunctional) chain extender, cross-linker, or curing agent may be used.

The curing agent mixture for the cover 16 of the present invention may have numerous variations. In a preferred embodiment, the curing agent is composed of 30 to 70 parts of a diol blend such as VIBRACURE® 250 to 70 to 30 parts of a diamine such as ETHACURE® 300. Alternatively, the diamine component may be a blend of different diamines such as a blend of EHTACURE® 100 with ETHACURE® 300.

The ratio of the polyurethane prepolymer blend to curing agent is determined by the nitrogen-carbon-oxygen group (NCO) content of the polyurethane prepolymer blend. For example, the NCO content of the TDI-terminated polyether or TDI-terminated polyester is preferably in the range of 4.0% to 9.0%, while the NCO content of the PPDI-terminated polyether is preferably in the range of 5.0% to 8.0%. The NCO content of the PPDI-terminated polyester is preferably in the range of 2.0% to 6.0%. The NCO content of the polyurethane prepolymer blend ranges from 2% to 8% of the polyurethane prepolymer blend. The amount of curing agent should correspond to 90% to 110% of the mol equivalence of the NCO content of the polyurethane prepolymer blend. The weight ratio of the polyurethane prepolymer blend to the curing agent is preferably in the range of about 10:1 to about 30:1.

Prior to curing, the polyurethane prepolymer blend and curing agent are preferably stored separately. The polyurethane is formed by first heating and mixing the polyurethane prepolymer blend with the curing agent in a mold, and then curing the mixture by applying heat and pressure for a predetermined time period. Additionally, a catalyst (e.g. dibutyl tin dilaurate, a tertiary amine, etc.) may be added to the mixture to expedite the casting process. Specific suitable catalysts include TEDA dissolved in di propylene glycol (such as TEDA L33 available from Witco Corp. Greenwich, Conn., and DABCO 33 LV available from Air Products and Chemicals Inc.,) which may be added in amounts of 2–5%, and more preferably TEDA dissolved in 1,4-butane diol which may be added in amounts of 2–5%. Another suitable catalyst includes a blend of 0.5% 33LV or TEDA L33 (above) with 0.1% dibutyl tin dilaurate (available from Witco Corp. or Air Products and Chemicals, Inc.) which is added to a curative such as VIBRACURE® A250. Furthermore, additives such as colorants may also be added to the mixture.

The polyurethane prepolymer blend material is preferably degassed and warmed in a first holding container prior to processing of the cover 16. The processing temperature for the polyurethane prepolymer blend is preferably in the range of about 100–220° F., and most preferably in the range of about 120 200° F. The polyurethane prepolymer blend is preferably flowable from the first holding container to a mixing chamber in a range of about 200–1100 grams of material per minute, or as needed for processing. In addition, the polyurethane prepolymer blend material may be agitated in the first holding container, in the range of 0–250 rpm, to maintain a more even distribution of material and to eliminate crystallization.

In the preferred embodiment, the curing agent is a blend of a diamine such as ETHACURE® 300 and a 1,4 butane diol and glycol such as VIBRACURE® A250. As previously mentioned, other curatives may also be utilized in forming the cover 16 of the golf ball 10 of the present invention. The curing agent is preferably degassed and warmed in a second holding container prior to processing of the cover 16. The processing temperature for the curative is preferably in the range of about 50–230° F., and most preferably in the range of about 80–200° F. The curing agent is preferably flowable from the second holding container to the mixing chamber in the range of about 15–75 grams of material per minute, or as needed. If a catalyst is used for processing the cover 16, then the catalyst is added to the curing agent in the second holding container to form a curative mixture. Suitable catalyst are described above. The curing agent and catalyst are agitated, in the range of about 0 to 250 rpm, to maintain an even distribution of catalyst in the curative mixture in the second holding container. It is preferred that the catalyst is added in an amount in the range of about 0.25–5% by weight of the combined polyurethane prepolymer blend and curing agent. Additives may be added to the curative mixture as desired. It was discovered that hydrolytic instability of the polyurethane polymer may be avoided by the addition of a stabilizer such as STABOXYL® (available from Rheinchemie, Trenton, N.J.) in amounts of about 0.25–5% of the polyurethane.

The polyurethane prepolymer blend and curative mixture are preferably added to the common mixing chamber at a temperature in the range of about 160–220 F. A colorant material, such as, for example, titanium dioxide, barium sulfate, and/or zinc oxide in a glycol or castor oil carrier, and/or other additive material(s) as are well known in the art, may be added to the common mixing chamber. The amount of colorant material added is preferably in the range of about 0–10% by weight of the combined polyurethane prepolymer blend and curative materials, and more preferably in the range of about 2–8%. Other additives, such as, for example, polymer fillers, metallic fillers, and/or organic and inorganic fillers (e.g. polymers, balata, ionomers, etc.) may be added as well to increase the specific gravity of the polyurethane cover 16 of the present invention. It was discovered that the addition of barytes (barium sulfate) or a blend of barytes and titanium dioxide (preferably added in a carrier glycol and/or castor oil) to the mixture, in the amounts of about 0.01–30%, may add sufficient weight to the polyurethane cover 16. The added weight to the cover 16 allows for a lower specific gravity for the core 12 thereby allowing for an increased resiliency of the core 12. The entire mixture is preferably agitated in the mixing chamber in the range of about 1 to 250 rpm prior to molding. A more detailed explanation of the process is set forth in U.S. Pat. No. 6,200,512, entitled Golf Balls And Methods Of Manufacturing The Same, filed on Apr. 20, 1999, which is hereby incorporated by reference in its entirety.

The core 12 of the golf ball 10 is the engine for the golf ball 10 such that the inherent properties of the core 12 will strongly determine the initial velocity and distance of the golf ball 10. A higher initial velocity will usually result in a greater overall distance for a golf ball. In this regard, the Rules of Golf, approved by the United States Golf Association (USGA) and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the core 12 for a USGA approved golf ball is constructed to enable the golf ball 10 to meet, yet not exceed, these limits.

The coefficient of restitution (COR) is a measure of the resilience of a golf ball. The COR is a measure of the ratio of the relative velocity of the golf ball after direct impact with a hard surface to the relative velocity before impact with the hard surface. The COR may vary from 0 to 1, with 1 equivalent to a completely elastic collision and 0 equivalent to a completely inelastic collision. A golf ball having a COR value closer to 1 will generally correspond to a golf ball having a higher initial velocity and a greater overall distance. The effect of a higher COR value is illustrated in FIG. 3 in which a golf club 20 strikes the golf ball 10. The force of the club 20 during a swing is transferred to the golf ball 10. If the golf ball has a high COR (more elastic), then the initial velocity of the golf ball will be greater than if the golf ball had a low COR. In general, a higher compression core will result in a higher COR value.

The core 12 of the golf ball 10 is generally composed of a blend of a base rubber, a cross-linking agent, a free radical initiator, and one or more fillers or processing aids. A preferred base rubber is a polybutadiene having a cis-1,4 content above 90%, and more preferably 98% or above.

The use of cross-linking agents in a golf ball core is well known, and metal acrylate salts are examples of such cross-linking agents. For example, metal salt diacrylates, dimethacrylates, or mono(meth)acrylates are preferred for use in the golf ball cores of the present invention, and zinc diacrylate is a particularly preferred cross-linking agent. A commercially available suitable zinc diacrylate is SR-416 available from Sartomer Co., Inc., Exton, Pa. Other metal salt di- or mono-(meth)acrylates suitable for use in the present invention include those in which the metal is calcium or magnesium. In the manufacturing process it may be beneficial to pre-mix some cross-linking agent(s), such as, e.g., zinc diacrylate, with the polybutadiene in a master batch prior to blending with other core components.

Free radical initiators are used to promote cross-linking of the base rubber and the cross-linking agent. Suitable free radical initiators for use in the golf ball core 12 of the present invention include peroxides such as dicumyl peroxide, bis-(t-butyl peroxy) diisopropyl benzene, t-butyl perbenzoate, di-t-butyl peroxide, 2,5-dimethyl-2,5-di-S-butylperoxy-hexane, 1,1-di (t-butylperoxy) 3,3,5-trimethyl cyclohexane, and the like, all of which are readily commercially available.

Zinc oxide is also preferably included in the core formulation. Zinc oxide may primarily be used as a weight adjusting filler, and is also believed to participate in the cross-linking of the other components of the core (e.g. as a coagent). Additional processing aids such as dispersants and activators may optionally be included. In particular, zinc stearate may be added as a processing aid (e.g. as an activator). Any of a number of specific gravity adjusting fillers may be included to obtain a preferred total weight of the core 12. Examples of such fillers include tungsten and barium sulfate. All such processing aids and fillers are readily commercially available. The present inventors have found a particularly useful tungsten filler is WP102 Tungsten (having a 3 micron particle size) available from Atlantic Equipment Engineers (a division of Micron Metals, Inc.), Bergenfield, N.J.

Table 1 below provides the ranges of materials included in the preferred core formulations of the present invention.

TABLE 1

Core Formulations

| Component | Preferred Range | Most Preferred Range |
|---|---|---|
| Polybutadiene | 100 parts | 100 parts |
| Zinc diacrylate | 20–35 phr | 25–30 phr |
| Zinc oxide | 0–50 phr | 5–15 phr |
| Zinc stearate | 0–15 phr | 1–10 phr |
| Peroxide | 0.2–2.5 phr | 0.5–1.5 phr |
| Filler (e.g. tungsten) | As desired (e.g. 2–10 phr) | As desired (e.g. 2–10 phr) |

In the present invention, the core components are mixed and compression molded in a conventional manner known to those skilled in the art. In a preferred form, the finished core 12 has a diameter of about 1.35 to about 1.64 inches for a golf ball 10 having an outer diameter of 1.68 inches. The core weight is preferably maintained in the range of about 32 to about 40 g. The core PGA compression is preferably maintained in the range of about 50 to 90, and most preferably about 55 to 80.

As used herein, the term PGA compression is defined as follows:PGA compression value=180 Riehle compression valueThe Riehle compression value is the amount of deformation of a golf ball in inches under a static load of 200 pounds, multiplied by 1000. Accordingly, for a deformation of 0.095 inches under a load of 200 pounds, the Riehle compression value is 95 and the PGA compression value is 85.

As is described above, the present invention preferably includes at least one boundary layer 14 that preferably is composed of a thermoplastic (e.g. thermoplastic or thermoplastic elastomer) or a blend of thermoplastics (e.g. metal containing, non-metal containing or both). However, the golf ball 10 may have several boundary layers 14 disposed between the core 12 and the cover 16. Most preferably the boundary layer 14 is composed of at least one thermoplastic that contains organic chain molecules and metal ions. The metal ion may be, for example, sodium, zinc, magnesium, lithium, potassium, cesium, or any polar metal ion that serves as a reversible cross-linking site and results in high levels of resilience and impact resistance. Suitable commercially available thermoplastics are ionomers based on ethylene copolymers and containing carboxylic acid groups with metal ions such as described above. The acid levels in such suitable ionomers may be neutralized to control resiliency, impact resistance and other like properties. In addition, other fillers with ionomer carriers may be used to modify (e.g. preferably increase) the specific gravity of the thermoplastic blend to control the moment of inertia and other like properties. Exemplary commercially available thermoplastic materials suitable for use in a boundary layer 14 of a golf ball 10 of the present invention include, for example, the following materials and/or blends of the following materials: HYTREL® and/or HYLENE ®® products from DuPont, Wilmington, Del., PEBAX® products from Elf Atochem, Philadelphia, Pa., SURLYN® products from DuPont, and/or ESCOR ® or IOTEK® products from Exxon Chemical, Houston, Tex.

The Shore D hardness of the boundary layer 14 should be about 65 or less. It is preferred that the boundary layer 14 have a hardness of between about 50–65 Shore D. In a preferred embodiment, the boundary layer 14 has a Shore D hardness in the range of about 57–65. One reason for preferring a boundary layer 14 with a Shore D hardness of 65 or lower is to improve the feel of the resultant golf ball. It is also preferred that the boundary layer 14 is composed of a blend of SURLYN® ionomer resins. SURLYN® 8150, 9150, and 6320 are, respectively, an ionomer resin composed of a sodium neutralized ethylene/methacrylic acid, an ionomer resin composed of a zinc neutralized ethylene/methacrylic acid, and an ionomer resin composed of a terpolymer of ethylene, methacrylic acid and n-butyl acrylate partially neutralized with magnesium, all of which are available from DuPont, Polymer Products, Wilmington, Del.

The boundary layer 14 may include a predetermined amount of a baryte mixture. The baryte mixture is included as 8 or 9 parts per hundred parts of the ionomer resins. One preferred baryte mixture is composed of 80% barytes and 20% of an ionomer, and is available from Americhem, Inc., Cuyahoga Falls, Ohio, under the trade designation 38534X1. The Shore D hardness provided in Table Three below was determined according to ASTM D2240.

Figure 4:
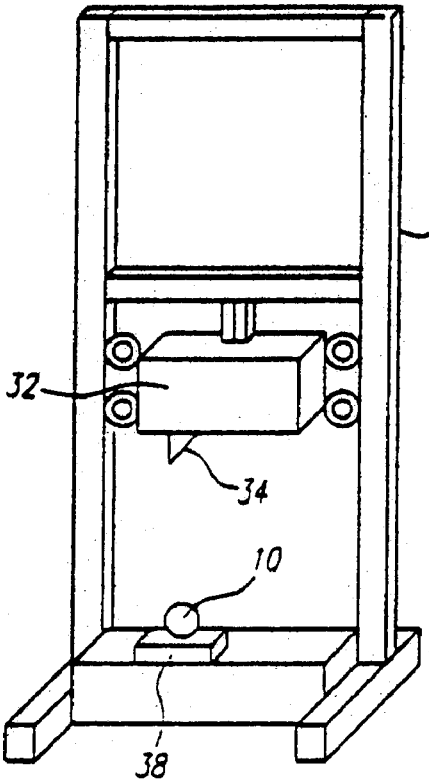
FIG. 4 illustrates a cover shear testing apparatus.
Figure 4B:
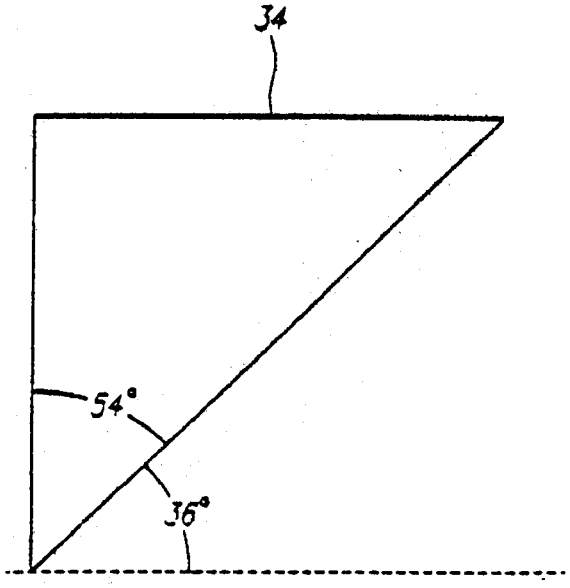
FIG. 4B illustrates an isolated view of the strike plate of the cover shear testing apparatus.
Figure 4A:
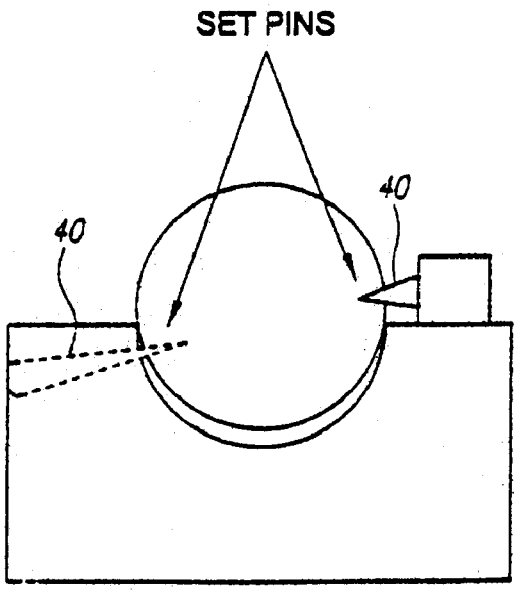
FIG. 4A illustrates an isolated view of the golf ball holder for the cover shear testing apparatus.

Twelve golf balls of the present invention were compared to a Maxfli REVOLUTION, a Titlelist PROFESSIONAL, a Titlelist DT-2, and a Bridgestone PRECEPT. All of the golf balls were subjected to a durability test to determine the durability of the golf balls in an objective manner. The durability tests were conducted on a cover shear apparatus as illustrated in FIGS. 4, 4A and 4B. The apparatus 30 includes a ten pound metal block 32 with a strike plate 34 on its bottom, mounted on a frame 36. A golf ball 10 is placed within a holder 38 and held by a set of pins 40. The strike plate 34 is angled at 54 degrees from vertical. The strike plate 34 is dropped from six inches above the golf ball 10.

The golf balls are measured on a cover shear criteria. The scale for each is from 1 to 5, with 1 being poor, 2 being below average, 3 being average, 4 being above average and 5 being excellent. The cover shear criteria is as follows: 1-portion of the cover has been completely sheared off and dimples have been greatly reduced or removed; 2-the cover material has been sheared to the extent that the flaps of the cover are visible, and severe bunching or peeling back of the cover material is evident; 3-there is moderate cutting of the cover material to the extent that internal portions of the cover are exposed, but the cover is intact; 4-indentations in the cover are evident, but there is no bunching of the cover material; 5-groove marks are difficult to see and slight score marks may or may not be visible, and there is no deformation of the cover material.

Table Two below sets forth physical data for suitable boundary layers 14 that were manufactured and incorporated into specific embodiments of twelve example golf balls of the present invention. As is shown in Table 3 below, each of the boundary layers 14 were composed of an ionomer blend and the specific percentages are provided. The thickness of each of the boundary layers 14 varies from 0.0525 and 0.058 inches. The shore D hardness varies between 58 and 62.

TABLE TWO

| Ball | SURLYN ® | | | Thickness | Shore D |
|---|---|---|---|---|---|
| Ex. No. | %8150 | %9150 | %6320 | (inches) | Hardness |
| 1 | 40 | 40 | 20 | 0.058 | 58 |
| 2 | 45 | 45 | 10 | 0.0525 | 62 |
| 3 | 45 | 45 | 10 | 0.0525 | 62 |
| 4 | 40 | 40 | 20 | 0.058 | 60 |
| 5 | 40 | 40 | 20 | 0.058 | 60 |
| 6 | 40 | 40 | 20 | 0.058 | 60 |
| 7 | 45 | 45 | 20 | 0.0525 | 62 |
| 8 | 45 | 45 | 20 | 0.0525 | 62 |
| 9 | 45 | 45 | 10 | 0.0525 | 62 |
| 10 | 45 | 45 | 10 | 0.0525 | 62 |
| 11 | 45 | 45 | 10 | 0.0525 | 62 |
| 12 | 45 | 45 | 10 | 0.0525 | 62 |

TABLE THREE

| Ball | Ball Weight (grams) | Ball Compression (points) | Average Diameter (inches) | Core Diameter (inches) | Core Compression (points) |
|---|---|---|---|---|---|
| 1 | 45.65 | 92 | 1.684 | 1.489 | 60 |
| 2 | 45.86 | 98 | 1.684 | 1.515 | 70 |
| 3 | 45.92 | 101 | 1.684 | 1.515 | 75 |
| 4 | 45.82 | 94 | 1.684 | 1.489 | 60 |
| 5 | 45.83 | 99 | 1.684 | 1.489 | 65 |
| 6 | 45.90 | 99 | 1.684 | 1.489 | 65 |
| 7 | 45.86 | 96 | 1.684 | 1.515 | 70 |
| 8 | 45.84 | 100 | 1.684 | 1.515 | 75 |
| 9 | 45.84 | 101 | 1.684 | 1.515 | 75 |
| 10 | 45.89 | 98 | 1.684 | 1.515 | 65 |
| 11 | 45.83 | 95 | 1.682 | 1.515 | 65 |
| 12 | 45.84 | 97 | 1.681 | 1.515 | 69 |

Table Four sets forth the properties of each of the cover layers 16 for each of the twelve golf balls 10. The number of parts of each polyurethane prepolymer for each of the cover layers 16 is provided in columns 2 through 6. Column 2 includes the number of parts of the TDI-terminated polyether prepolymer, ADIPRENE® LF950. Column 3 includes the number of parts of the PPDI terminated polyether prepolymer, ADIPRENE® LFPX950. Column 4 includes the number of parts of the PPDI terminated polyester (polycaprolactone) prepolymer, ADIPRENE® LFPX2950. Column 5 includes the number of parts of the PPDI terminated polyether prepolymer, ADIPRENE® LFPX590. The difference between LFPX590 and LFPX950 is the NCO content and the molecular weight of the polyol (ether) backbone, with LFPX950 having a NCO content in the range of approximately 5.45% to approximately 5.75%, and LFPX590 having a NCO content in the range of approximately 5.6% to approximately 6.2%. Column 6 includes the number of parts of the PPDI terminated polyester (polycaprolactone) prepolymer, ADIPRENE® LFPX2952. The difference between LFPX2950 and LFPX2952 is the NCO content, with LFPX2950 having a NCO content in the range of approximately 3.55% to approximately 3.85%, and LFPX2952 having a NCO content in the range of approximately 4.45% to approximately 5.05%. Each of the polyurethane prepolymer blends for examples 1–9 and 11–12 were cured with a blend of curing agents. The blend of curing agents was composed of 50 parts ETHACURE 300 (a diamine curing agent) and 50 parts VIBRACURE A250 (a blend of a 1,4 butane diol and glycol). Example 10 of the golf balls 10 of the present invention was cured with a blend of 70 parts ETHACURE 300 and 30 parts VIBRACURE A250. The thickness of the cover layer 16 for each of the twelve golf balls 10 of present invention is either 0.0300 inches or 0.0375 inches. The shore D hardness of the cover layer 16 for each of the twelve golf balls 10 of present invention is either 47 degrees or 53 degrees.

TABLE FOUR

| Ball | Polyurethane prepolymer | | | | | Thickness | Shore D Hardness |
|---|---|---|---|---|---|---|---|
| Ex. No. | TDI | PPDI-1 | PPDI-2 | PPDI-3 | PPDI-4 | (inches) | |
| 1 | 30 | 70 | | | | 0.0375 | 47 |
| 2 | 30 | | 20 | 50 | | 0.0300 | 53 |
| 3 | 30 | | | | 70 | 0.0300 | 47 |
| 4 | 30 | | | | 70 | 0.0375 | 47 |
| 5 | 30 | 50 | 20 | | | 0.0375 | 47 |
| 6 | 30 | | | | 70 | 0.0375 | 47 |
| 7 | 30 | 50 | 20 | | | 0.0300 | 47 |
| 8 | 30 | | 20 | 50 | | 0.0300 | 53 |
| 9 | 30 | 70 | | | | 0.0300 | 47 |
| 10 | 20 | 80 | | | | 0.0300 | 47 |
| 11 | 30 | 70 | | | | 0.0300 | 47 |
| 12 | 30 | 70 | | | | 0.0300 | 47 |

TABLE FIVE

| | | 110 mph Driver | | 90 mph Driver | | 79 mph 5-Iron |
|---|---|---|---|---|---|---|
| Ball | Shear (1–5) | Carry (yds) | Total (yds) | Carry (yds) | Total (yds) | Carry (yds) |
| Revolution | 5 | 251.5 | 269.6 | 194.5 | 218.6 | 158.1 |
| Precept EV | 4 | 253.1 | 270.6 | 196.2 | 220.4 | 162.7 |
| Professional | 4 | 248.2 | 266.1 | 190.3 | 216.0 | 158.4 |
| DT 2-piece | 1 | 256.1 | 274.7 | 197.1 | 222.8 | 164.8 |
| 1 | 4.25 | 253.9 | 271.1 | 195.7 | 220.6 | 161.2 |
| 2 | 4.0 | 255.5 | 274.1 | 196.7 | 222.4 | 163.2 |
| 3 | 4.0 | 257.3 | 272.2 | 199.2 | 221.8 | 162.0 |
| 4 | 4.0 | 253.9 | 269.7 | 197.0 | 220.4 | 160.4 |
| 5 | 4.0 | 254.3 | 274.1 | 198.2 | 220.4 | 159.1 |
| 6 | 4.25 | 254.4 | 269.4 | 197.4 | 220.6 | 160.1 |
| 7 | 4.25 | 255.9 | 271.4 | 198.3 | 221.9 | 161.6 |
| 8 | 3.75 | 257.2 | 273.2 | 198.2 | 222.7 | 163.6 |
| 9 | 3.75 | 256.8 | 273.6 | 197.2 | 222.7 | 163.8 |

TABLE FIVE-continued

| | | 110 mph Driver | | 90 mph Driver | | 79 mph 5-Iron |
|---|---|---|---|---|---|---|
| Ball | Shear (1–5) | Carry (yds) | Total (yds) | Carry (yds) | Total (yds) | Carry (yds) |
| 10 | 3.75 | 256.7 | 275.5 | 197.5 | 222.6 | 161.3 |
| 11 | 4.5 | 255.5 | 273.3 | 196.8 | 222.5 | 160.9 |
| 12 | 4.5 | 257.3 | 274.2 | 196.8 | 221.5 | 161.1 |

Table Five illustrates the comparison testing between the twelve sample golf balls 10 the present invention, and the four well-known and well-played golf balls. All of the golf balls in Table Six were subjected to the afore-mentioned shear test and rated. The golf balls were also subject to a standard robot swing test at 110 miles per hour (mph) using a BIG BERTHA® HAWKEYE@ driver, at 90 mph using a BIG BERTHA® HAWKEYE® driver, and at 79 mph using a BIG BERTHA® X-12 @ five iron. Although the REVOLUTION® had the best shear rating, its carry and total distance was only better than the Titlelist PROFESSIONAL®. Example 12 of the golf balls 10 of the present invention had a durability rating of 4.5, and it had a carry six yards better than the REVOLUTION at 110 mph using a BIG BERTHA® HAWKEYE® driver. The best distance at 110 mph using a BIG BERTHA® HAWKEYE® driver was example 10 of the golf balls 10 of the present invention which had a carry yardage of 256.7 yards and a total distance of 275.5 yards with a durability of 3.75. The next closest golf ball in distance was the DT-2, however, it only had a durability of 1. Table Six demonstrates that the golf ball 10 of the present invention provides objectively the best overall durability with the best overall distance.

The above examples demonstrate the efficacy of the golf ball 10 of the present invention and are not intended to limit the scope or spirit of the present invention.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a core having a diameter of 1.35 inches to 1.64 inches, the core comprising polybutadiene material, zinc oxide in an amount of 5 to 15 parts per hundred parts of polybutadiene, zinc stearate in an amount of 1 to 10 parts per hundred parts of polybutadiene, zinc diacryalate in an amount of 20 to 35 parts per hundred parts of polybutadiene, a peroxide in an amount of 0.5 to 1.5 parts per hundred parts of polybutadiene, and tungsten in an amount of 2 to 10 parts per hundred parts of polybutadiene, the core having a PGA compression of 55 to 80 points;

an intermediate layer covering the core, the intermediate layer having a Shore D hardness ranging from 50 to 65;

a cover enclosing the intermediate layer, the cover composed of a thermoset polyurethane material.

2. A golf ball comprising:

a core having a diameter of 1.35 inches to 1.64 inches, the core comprising polybutadiene material, zinc oxide in an amount of 5 to 15 parts per hundred parts of polybutadiene, zinc stearate in an amount of 1 to 10 parts per hundred parts of polybutadiene, zinc diacryalate in an amount of 20 to 35 parts per hundred parts of polybutadiene, a peroxide in an amount of 0.5 to 1.5 parts per hundred parts of polybutadiene, and tungsten in an amount of 2 to 10 parts per hundred parts of polybutadiene, the core having a PGA compression of 55 to 80 points;

an intermediate layer covering the core, the intermediate layer composed of a blend of ionomers and having a Shore D hardness ranging from 50 to 65;

a cover enclosing the intermediate layer, the cover composed of a thermoset polyurethane material;

wherein the golf ball has a PGA compression ranging from 92 to 101 points, and the golf ball has a mass of 45.65 grams to 45.92 grams.

3. A golf ball comprising:

a core having a diameter of 1.35 inches to 1.64 inches, the core comprising polybutadiene material, zinc oxide in an amount of 5 to 15 parts per hundred parts of polybutadiene, zinc stearate in an amount of 1 to 10 parts per hundred parts of polybutadiene, zinc diacryalate in an amount of 20 to 35 parts per hundred parts of polybutadiene, a peroxide in an amount of 0.5 to 1.5 parts per hundred parts of polybutadiene, and tungsten in an amount of 2 to 10 parts per hundred parts of polybutadiene, the core having a PGA compression of 55 to 80 points;

an intermediate layer covering the core, the intermediate layer composed of a blend of ionomers and having a Shore D hardness ranging from 50 to 65;

a cover enclosing the intermediate layer, the cover composed of a thermoset polyurethane material formed from a blend of polyurethane prepolymers and at least one curing agent;

wherein the golf ball has a PGA compression ranging from 92 to 101 points, the golf ball has a mass of 45.65 grams to 45.92 grams, and the golf ball has a diameter of approximately 1.68 inches.

* * * * *